US005640810A

United States Patent [19]

Pietersen

[11] Patent Number: 5,640,810

[45] Date of Patent: Jun. 24, 1997

[54] GUTTER COVER

[76] Inventor: Alexander A. G. Pietersen, 29 Raynor Rd., Morristown, N.J. 07960

[21] Appl. No.: 584,269

[22] Filed: Jan. 11, 1996

[51] Int. Cl.[6] ..... E04D 13/00

[52] U.S. Cl. ..... 52/12; 210/474

[58] Field of Search ..... 52/11, 12; 210/474

[56] References Cited

U.S. PATENT DOCUMENTS

| | | | |
|---|---|---|---|
| 1,788,383 | 1/1931 | Delery | 210/498 X |
| 3,295,264 | 1/1967 | Olson | 52/12 |
| 4,418,504 | 12/1983 | Lassiter | 52/12 |

*Primary Examiner*—Creighton Smith
*Attorney, Agent, or Firm*—Alfred C. Hill

[57] ABSTRACT

A gutter cover for a building having a shingled roof and a gutter fastened to the building to receive water from the roof, the cover reducing the amount of debris entering the gutter, the cover comprising a rectangular sheet of rigid plastic material of predetermined length having a first solid rectangular section coextensive with the sheet and disposed parallel to the gutter to be inserted under a first course of shingles of the roof and a second rectangular section coextensive with and parallel to the first section to cover the gutter, the second section having a plurality of perforations therethrough through which the water can pass into the gutter; and a hinge formed in the sheet interconnecting the first and second sections to enable raising the second section to clean debris from the gutter that has passed through the plurality of perforations.

12 Claims, 2 Drawing Sheets

GUTTER COVER

BACKGROUND OF THE INVENTION

The present invention relates to gutter covers or shields which prevent leaves and the like from collecting in a gutter and more particularly to a flip-up gutter cover. Gutter covers, guards or shields have in the past been formed of mesh which are presently available commercially for installation on top of the gutters of houses and other buildings for the purpose of blocking the entry of leaves and other debris while at the same time allowing rain or snow melted water to drain into the gutters. Installation is complicated by the fact that such a wire mesh guard, or cover, is commonly marketed in rolled form and must therefore be unrolled or flattened prior to installation. Because of its' wire mesh construction, such a cover is readily deformed, increasing difficulty of installation and, at least in some instances, diminishing the effectiveness of the cover following installation. The usefulness of such a product is further diminished by the difficulty of temporarily removing the cover when it becomes necessary to remove debris from the gutter that manages to enter the gutter despite the presence of the gutter guard.

Efforts have been made to alleviate the later problem by hinging the wire mesh cover upon a gutter, or upon the roof adjacent the cover, so that the hinged mesh cover may be more readily lifted and lowered whenever cleaning of a gutter is required. Typical construction of this type are disclosed in U.S. Pat. Nos. 2,469,841; 2,542,155; 2,841,100; 3,420,378; 3,630,383; 3,834,091; 3,977,135; 4,032,496 and 4,351,134.

While the hinged mounting of such mesh or screen covers does facilitate gutter cleaning, it tends to further increase the difficulty of installation, particularly on gutters of the type not commonly in use wherein the bridging straps extend over such a gutter for bracing and supporting the gutter along the edge of the roof. Furthermore, in operation such mesh gutter covers may be less than satisfactory because deformation of the wire mesh material may interfere with pivital movement of the gutter covers between their raised and lowered positions. The hinges for such gutter covers are generally connected to the outer edge of the gutter and the opposite edge of the screen may be flipped up from its useful position along the roof. These gutter shields have several disadvantages. For example, because some debris will always pass through the mesh cover, it is necessary to periodically clean the inside of the gutter. To do so, a person must reach over the prior art flip-up cover from his already precarious position on a ladder.

SUMMARY OF THE INVENTION

An object of the present invention is to provide a hinged gutter cover which, when in its flip-up position will be completely out of the way of the person servicing the gutter.

Another object of the present invention is to provide a gutter cover which is easily manufactured and has a hinge built into the cover itself.

Still another object of the present invention is to provide a gutter cover which is inexpensive to make, may be made in different colors and is inexpensive to sell.

A further object of the present invention is to provide a gutter cover which is easily cut to properly fit the gutter.

Still a further object of the present invention is that the gutter cover includes a turned over edge or lip extending beyond the outer edge of the gutter to prevent rain or melted snow water from dirtying the outer surface of the gutter.

A feature of the present invention is the provision of a gutter cover for a building having a shingled roof and a gutter fastened to the building to receive rain water or melted snow water from the roof, the cover reducing the amount of debris entering the gutter, the cover comprising a rectangular sheet of rigid plastic material of predetermined length having a first solid rectangular section coextensive with the sheet and disposed parallel to the gutter to be inserted under a first course of shingles of the roof and a second rectangular section coextensive with and parallel to the first section to cover the gutter, the second section having a plurality of perforations therethrough through which the water can pass into the gutter; and a hinge means formed in the sheet interconnecting the first and second sections to enable raising the second section to clean debris from the gutter that has passed through the plurality of perforations.

Another feature of the present invention is the provision of a reduced thickness of the sheet parallel to, between and coextensive with the first and second sections to provide the hinge means.

Still another feature of the present invention is the provision of a plurality of depressions in an upper surface of the second section, each of the depressions being disposed adjacent a different one of the plurality of perforations to direct the water into its associated one of the plurality of perforations.

BRIEF DESCRIPTION OF THE DRAWING

Above-mentioned and other features and objects of the present invention will become more apparent by reference to the following description taken in conjunction with the accompanying drawing, in which.

DESCRIPTION OF THE PREFERRED EMBODIMENT

Figure 1:
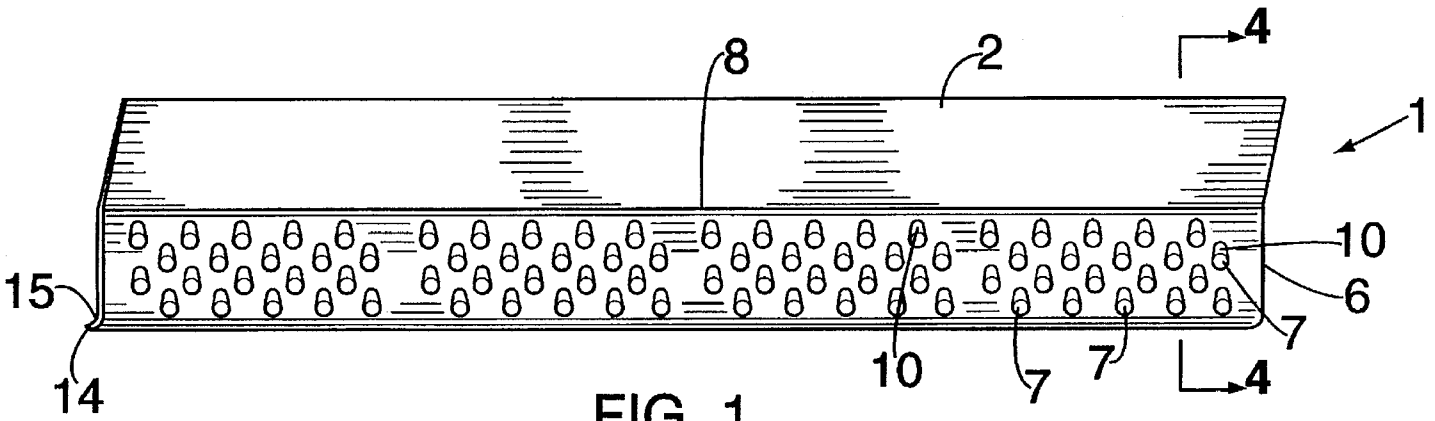
FIG. 1 is a plan view of the gutter cover in accordance with the principles of the present invention.
Figure 2:
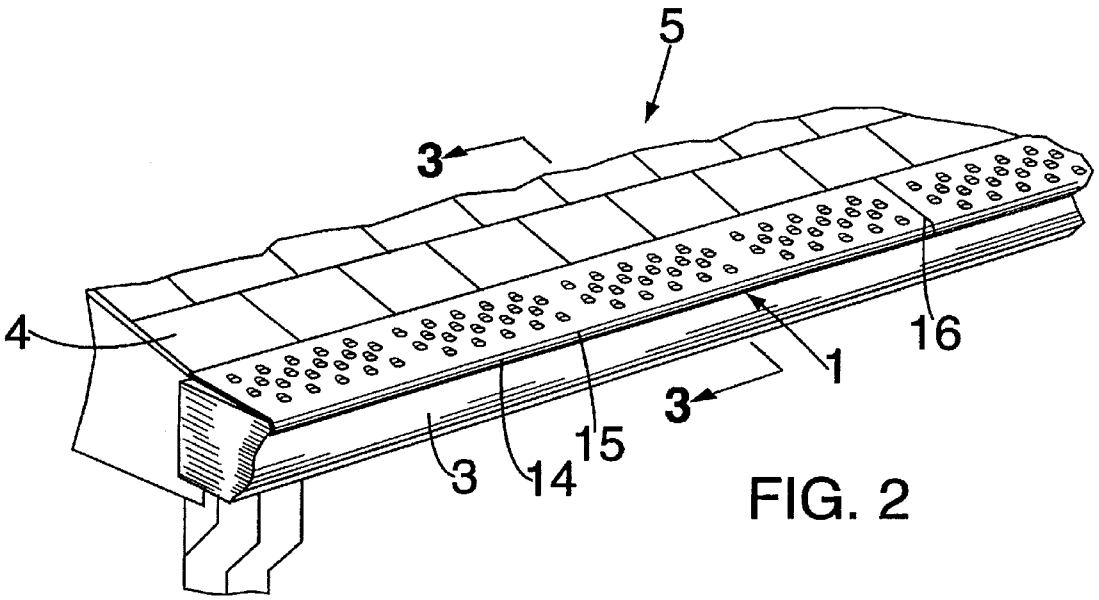
FIG. 2 is a perspective view of the gutter cover in accordance with the principles of the present invention installed on a gutter secured to a building.
Figure 3:
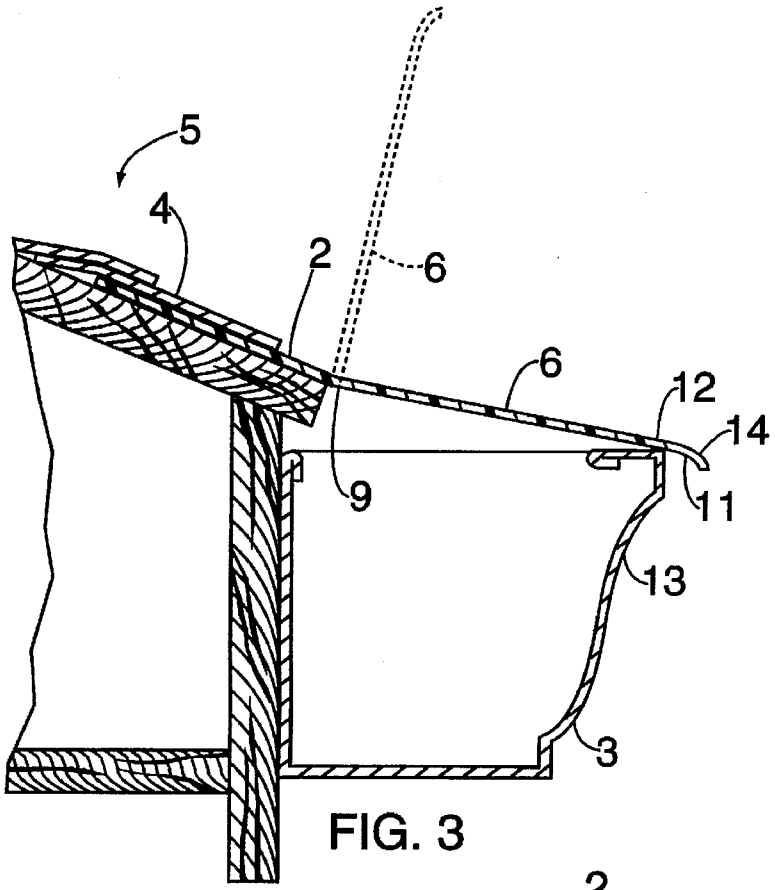
FIG. 3 is a cross-sectional view taken along line 3—3 of FIG. 2 illustrating the gutter cover of the present invention covering the gutter and in a dotted illustration in its' raised position.
Figure 4:
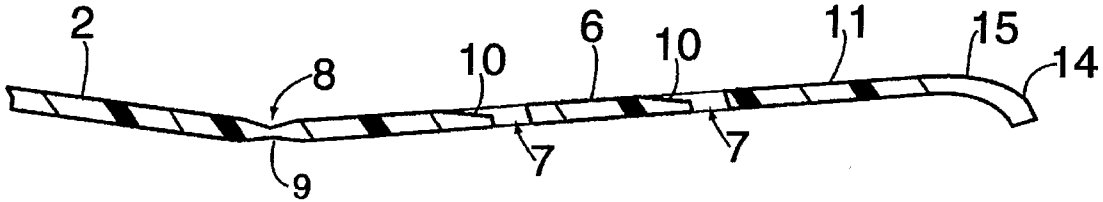
FIG. 4 is an enlarged cross-sectional view taken along line of FIG. 1 illustrating the perforations and depressions in accordance with the principles of the present invention.

Referring to FIGS. 1–4, the gutter cover of the present invention is illustrated as including a rectangular sheet 1 of rigid plastic material of a predetermined length having a first solid rectangular section 2 coextensive with the sheet 1 and disposed parallel to the gutter 3 to be inserted under the first course 4 of the shingles of roof 5. Sheet 1 further includes a second section 6 coextensive with and parallel to the first section 2 to cover the gutter 3. Second section 6 includes therein a plurality of perforations 7 therethrough through which the rain water and melted snow water can pass into gutter 3. The sheet 1 further includes between sections 2 and 6 a hinge means 8 which is provided by a reduced thickness 9 in sheet 1 which is parallel to, between and coextensive with the first and second sections 2 and 6 to enable raising the second section 6 as illustrated in FIG. 3 to clean debris from gutter 3 that has passed through the plurality of perforations 7.

The second section 6 further includes a plurality of depressions 10 in an upper surface of the second section 6, each of the depressions 10 being disposed adjacent a different one of the plurality of perforations 7 to direct the rain water and melted snow water into its associated one of the plurality of perforations 7.

The second section 6 further includes a portion 11 that is remote from the roof 5 extending beyond an outer edge 12 of gutter 3 to prevent the rain water or melted snow water from dirtying the outer surface 13 of gutter 3. To assist in preventing the rain water and melted snow water from dirtying the outer surface 13 of gutter 3, a curved lip 14 is provided on an outer edge 15 of portion 11 which extends downwardly so that the water that fails to passes through the perforations can drop to the ground without dirtying surface 13 of gutter 3.

As mentioned previously, the gutter cover 1 of the present invention is easily manufactured using a molding process since the material of the cover is a plastic material which is rigid enough so it will not deform when installed and when in use. The hinge 8 is built into the sheet 1 of plastic material between sections 2 and 6 by a reduced thickness 9 of the material. The plastic material can be any color desired to conform to the color of the building upon which it is installed. The installation of the gutter cover is easily accomplished and can be easily cut to properly fit the length of the gutter using either scissors or a utility knife. Due to the material used and ease of manufacture the, gutter cover should be inexpensive not only to make, but also to sell. Due to the configuration of the gutter guard particularly with regard to the portion 11 and the curved lip 14, the outer surface 13 of the gutter 3 will not be dirtied by rain water and/or melted snow water running over the gutter cover without entering the perforations 7 and falling to the ground.

The plate 1 is dimensioned to extend under the first course of shingles 4 and having the second section 6 cover the top or opening of gutter 3 with a portion 11 thereof going beyond the outer edge 12 of gutter 3 to prevent dirtying the surface 13 of the gutter. While the dimensions may be varied depending on the size of the gutter 3, it has been found that for use with the standard residential gutter the section 6 should have a width within the range of approximately 5" to 7" preferably 5.25" to 5.75", and a length of about 30" to 60" per sections preferably about 36" to 48". A series of such plates or covers are mounted along the edge of the roof for the full length of the gutter, such plates being arranged in an end to end alignment as illustrated in FIG. 2 at 16.

While I have described above the principles of my invention in connection with specific apparatus, it is to be clearly understood that this description is made only by way of example and not as a limitation to the scope of my invention as set forth in the objects thereof and in the accompanying claims.

I claim:

1. A gutter cover for a building having a shingled roof and a gutter fastened to said building to receive water from said roof, said cover for reducing debris entering said gutter, said covering comprising:

a rectangular sheet of rigid plastic material of predetermined length having a first solid rectangular section coextensive with said sheet adapted to be disposed parallel to said gutter and adapted to be inserted under a first course of shingles of said roof and a second rectangular section coextensive with and parallel to said first section to cover said gutter, said second section having a plurality of perforations therethrough for said water to pass into said gutter; and a hinge means formed in said sheet interconnecting said first and second sections to enable raising said second section to clean debris from said gutter that has passed through said plurality of perforations.

2. A gutter cover according to claim 1, wherein said hinge means includes a reduced thickness of said sheet parallel to, between and coextensive with said first and second sections.

3. A gutter cover according to claim 2, further including a plurality of depressions in an upper surface of said second section, each of said depressions being disposed adjacent a different one of said plurality of perforations to direct said water into its associated one of said plurality of perforations.

4. A gutter cover according to claim 3, wherein said second section further includes a portion thereof remote from said roof extending a predetermined distance beyond an outer edge of said gutter to prevent said water from dirtying an outer surface of said gutter.

5. A gutter cover according to claim 4, wherein said portion includes a curved lip on an edge of said portion remote from said gutter extending downward to assist in preventing said water from dirtying said outer surface of said gutter.

6. A gutter cover according to claim 2, wherein said second section further includes a portion thereof remote from said roof extending a predetermined distance beyond an outer edge of said gutter to prevent said water from dirtying an outer surface of said gutter.

7. A gutter cover according to claim 6, wherein said portion includes a curved lip on an edge of said portion remote from said gutter extending downward to assist in preventing said water from dirtying said outer surface of said gutter.

8. A gutter cover according to claim 1, further including a plurality of depressions in an upper surface of said second section, each of said depressions being disposed adjacent a different one of said plurality of perforations to direct said water into its associated one of said plurality of perforations.

9. A gutter cover according to claim 8, wherein said second section further includes a portion thereof remote from said roof extending a predetermined distance beyond an outer edge of said gutter to prevent said water from dirtying an outer surface of said gutter.

10. A gutter cover according to claim 9, wherein said portion includes a curved lip on an edge of said portion remote from said gutter extending downward to assist in preventing said water from dirtying said outer surface of said gutter.

11. A gutter cover according to claim 1, wherein said second section further includes a portion thereof remote from said roof extending a predetermined distance beyond an outer edge of said gutter to prevent said water from dirtying an outer surface of said gutter.

12. A gutter cover according to claim 11, wherein said portion includes a curved lip on an edge of said portion remote from said gutter extending downward to assist in preventing said water from dirtying said outer surface of said gutter.

* * * * *